US005279238A

United States Patent [19]

Ross, Jr.

[11] Patent Number: 5,279,238

[45] Date of Patent: Jan. 18, 1994

[54] OIL CONTAINMENT SYSTEM FOR PROTECTING THE HULL OF AN OIL TANKER FROM LEAKING IN THE EVENT OF GROUNDING OR COLLISION

[76] Inventor: Kingston Ross, Jr., 111 Elkinton Ave., Chester, Pa. 19013

[21] Appl. No.: 974,868

[22] Filed: Nov. 12, 1992

Related U.S. Application Data

[63] Continuation-in-part of Ser. No. 748,801, Aug. 22, 1991, abandoned.

[51] Int. Cl.[5] ..... B63B 25/12

[52] U.S. Cl. ..... 114/74 R; 114/228; 220/402; 220/403

[58] Field of Search . 114/74 R, 74 A, 74 T, 227, 228, 256; 220/402, 403, 220/562

[56] References Cited

U.S. PATENT DOCUMENTS

| | | | |
|---|---|---|---|
| 3,844,239 | 10/1974 | McLaughlin et al. | 114/74 R |
| 3,859,944 | 1/1975 | Warner | 114/74 R |
| 4,347,798 | 9/1982 | Gallagher | 114/74 R |
| 5,070,801 | 12/1991 | Frederick | 114/74 R |

*Primary Examiner*—Sherman D. Basinger

[57] ABSTRACT

A shock absorbing cushioning mat designed to protect the compartment liner of a liquid or oil carrying sea going vessel from tear or puncture by steel from the vessel's structure being forced inward by the external pressure created by grounding or collision of a bulk liquid carrying sea going vessel, while providing a firm yet flexible foundation for the compartment liner to eliminate or greatly reduce the potential for spillage of the cargo. The present invention also addresses the problem of compartment liner fasteners coming apart due to the continued motion of a sea going bulk liquid carrying vessel graveling across a body of water.

13 Claims, 4 Drawing Sheets

OIL CONTAINMENT SYSTEM FOR PROTECTING THE HULL OF AN OIL TANKER FROM LEAKING IN THE EVENT OF GROUNDING OR COLLISION

This application is a continuation in part application of co-pending application Ser. No. 07/748,801 filed on Aug. 22, 1991, now abandoned.

FIELD OF THE INVENTION

This invention relates to a System for Protecting the Hull of an Oil Tanker from Leakage in the Event of Grounding.

BACKGROUND ART

The compartment liner conception of use with liquid bulk carrying vessels as expressed in the prior art is well known. Compartment liners and buffer zones have been incorporated into modern tanker vessels in an effort to avert the tremendous damage that floating oil spills cause. However, the bulk liquid carrying vessel industry has come under increasing pressure to create safer methods to transport bulk liquids across open seas.

Compartment liners and buffer zones are vulnerable to puncture and tear in the event of grounding or collision wherein steel is forced inward by external pressure. Double hulled vessels have been suggested as a way to avert these inboard steel hazards in the event of grounding or collision. However, the ten to twelve foot void between hulls is wasted space and renders the double hull concept inefficient. Even double hulled vessels are still vulnerable to spills.

Bulk liquid carrying tankers stand thirty to forty feet below the water's surface when loaded. Steel being forced in ward from a severe grounding would likely puncture or fracture the inner hull as there is nothing to absorb the shock of grounding of collision except empty space.

As previously stated, the compartment liner concept is well known in the oil tanker industry. However, the liners in most cases are composed of epoxy based filament reinforced coatings sprayed directly onto the walls of the vessel.

These spray-on coating are intended primarily to guard against leakage of oil or other pollutants through cracks or fractures in the welds of the vessel's steel plating, but would do little in preventing spillage in the event of grounding or collision.

The releasable fixed bag type liner of McLaughlin U.S. Pat. No. 3,844,239 which attached to the wall of the compartment would absorb the full impact or grounding or collision without the benefits of the present invention.

There is not protection provided against ruptures and tearing by steel beams in the event of a collision. The vessel's plating is forced inward in the event of a collision as no counterforce or cushioning effect is offered in the prior art. In the present invention the cargo is contained in the hermetically sealed vinyl bag or liner of a predetermined thickness and spaced apart from the hull of the tanker.

The vinyl liner is fastened in the compartment with enough play in the bag to allow unrestricted movement of the liquid cargo such as oil. The cargo contained within the liner is supported in most part by the vessel's superstructure by shock absorbing coil springs and heavy steel cables encased in thick rubber matting. This arrangement relieves much of the stress from the vessel's steel plating and welded seams.

DETAILED DESCRIPTION OF INVENTION

Figure 1:
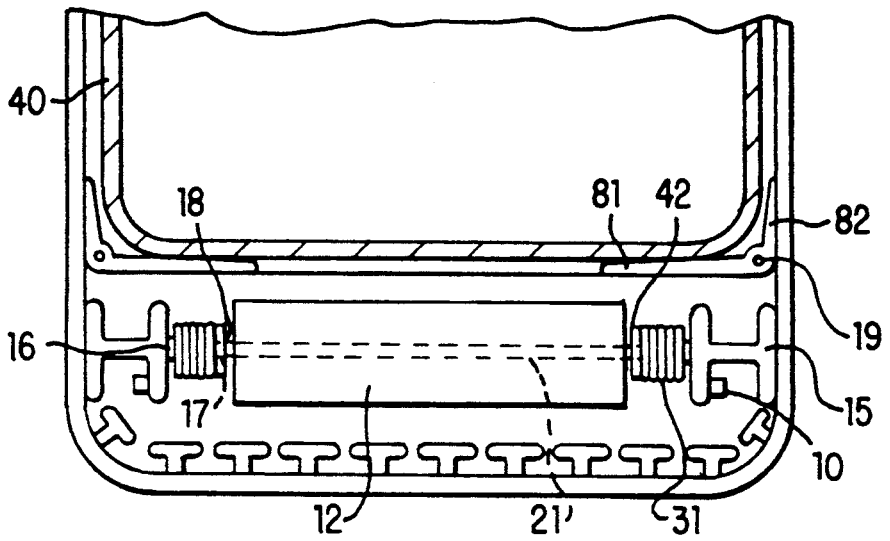
FIG. 1 shows a cutaway view of an oil compartment, showing the cushioning mat, the slide plate and the coil spring suspension connection to the anchor beam from a frontal view.
Figure 1A:
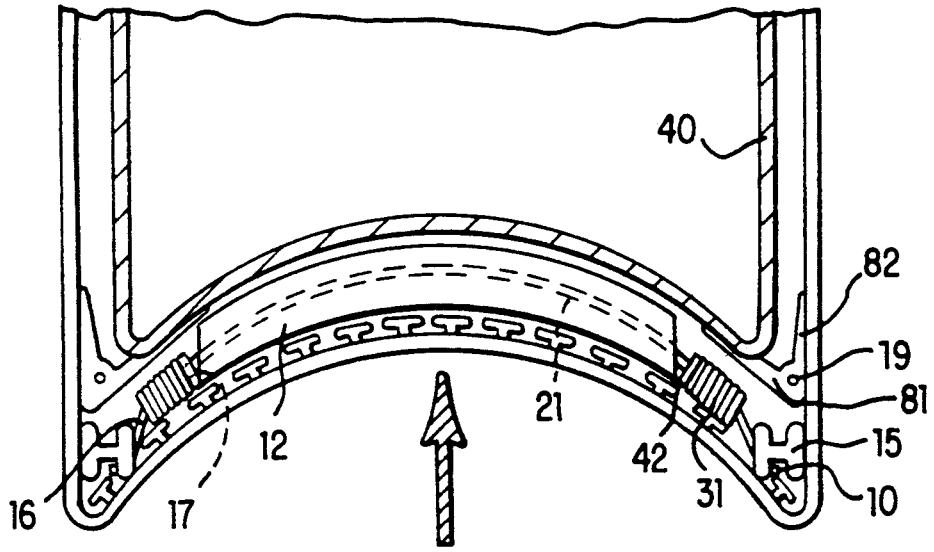
FIG. 1A shows the suspension system under stress whereby the external force is absorbed by the system, viewed from a cutaway frontal drawing.
Figure 2:
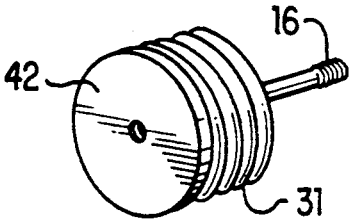
FIG. 2 shows a view of the butt plate, the coil spring, and the threaded end of the spring that bolts into the anchor beam.
Figure 3:
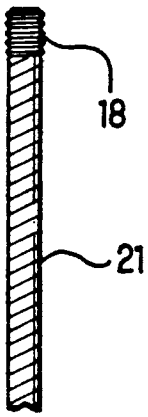
FIG. 3 shows the threaded end of the steel cable that screws into the butt plate of the coil springs.
Figure 4:
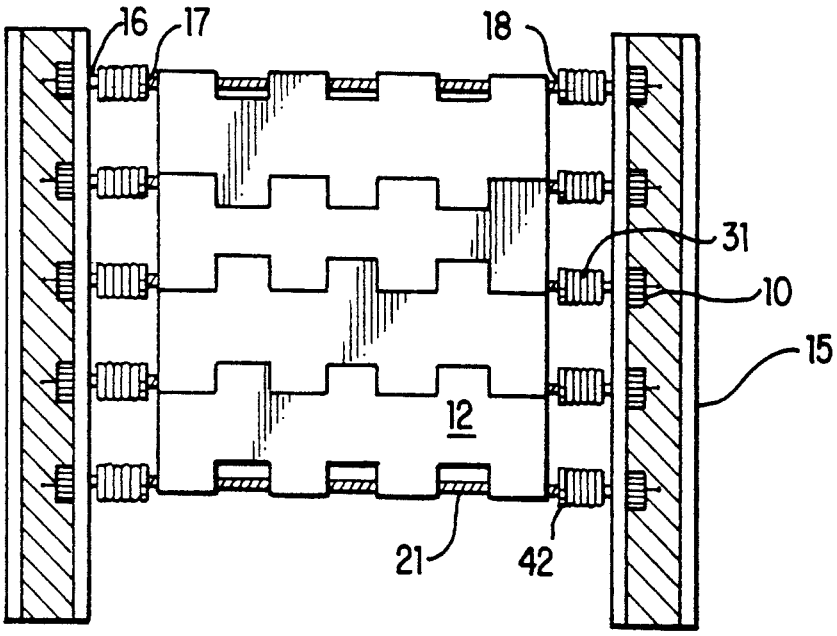
FIG. 4 shows a view of the cushioning mat and coil springs suspension bolted to the anchor beam looking downward.
Figure 6:
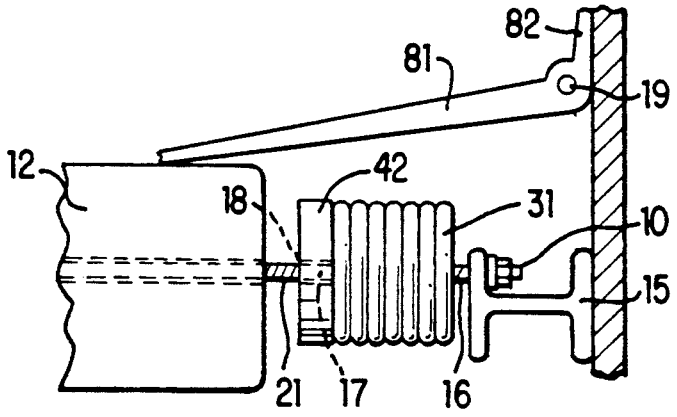
FIG. 6 shows an enlarged view of the suspension system with the cushioning mat the coil spring attached to the anchor beam.
Figure 5:
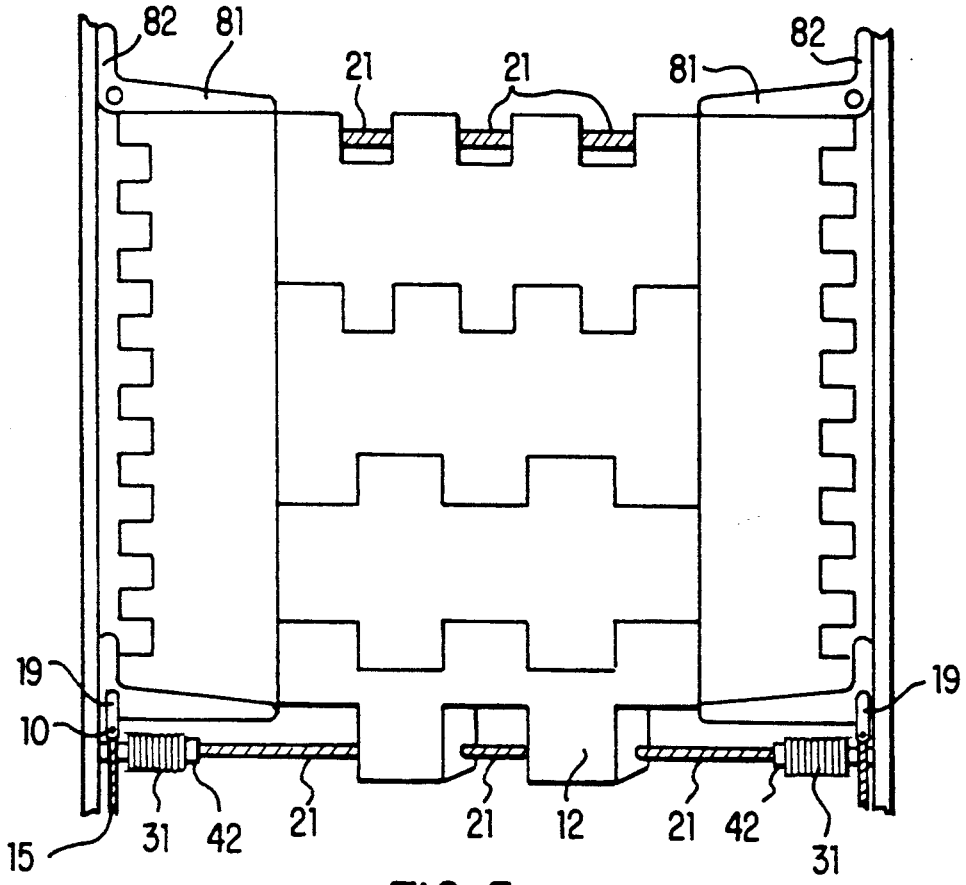
FIG. 5 shows a view of the suspension system with the slide plates overlapping the cushioning mat sections looking downward.
Figure 8:
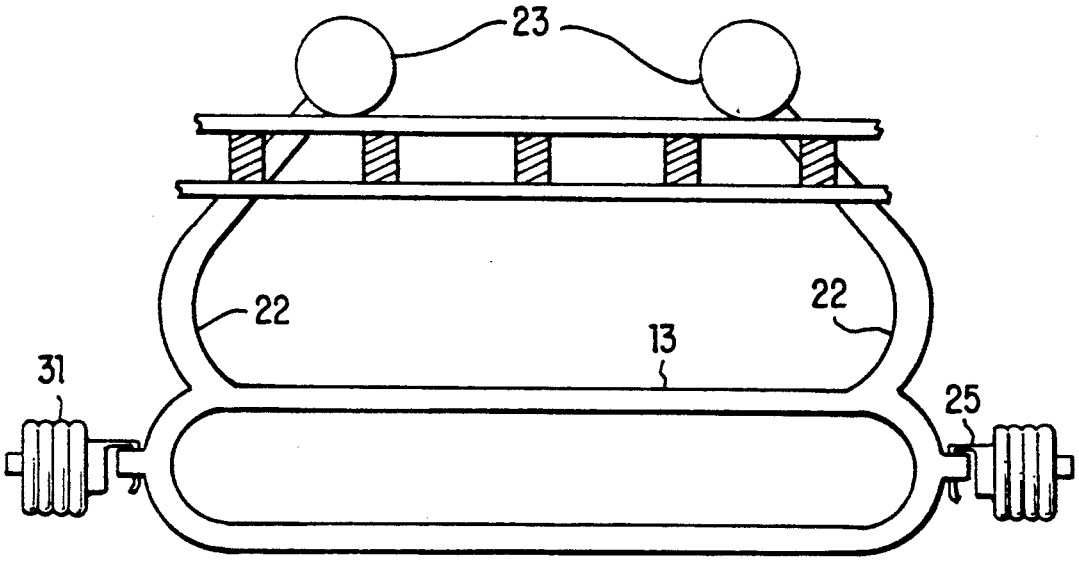
FIG. 8 shows a frontal view of modified version of the mat with air access means to supply the modified air filled cushioning mat.
Figure 7:
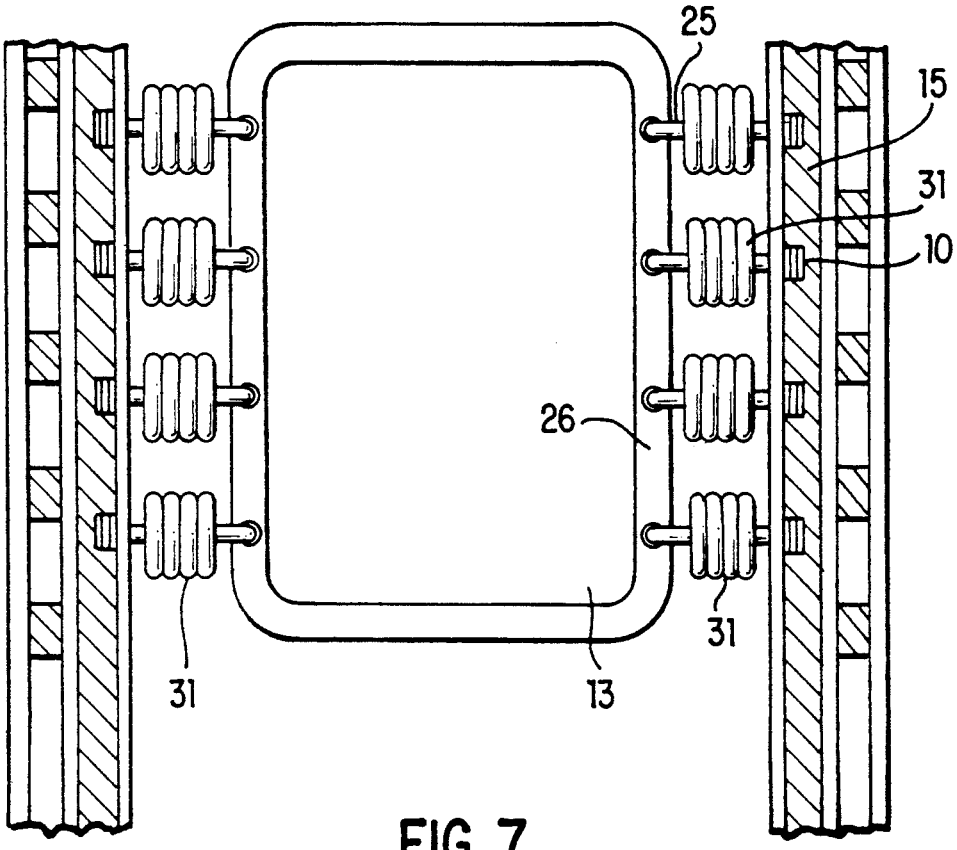
FIG. 7 shows a modified version of the cushioning mat with air access and hook attachment of coil springs to modified mat.

The present invention provides a shock absorbing cushioning mat 12 reinforced with coil spring 31 loaded steel cables 21 inserted through thick rubber flexible mat sections 12 to offer a counterforce to external pressure.

The thick shock absorbing cushioning mat 12 is designed to protect the compartment liner from steel beams forced inward from external force created from grounding or collision of the hull of a sea going bulk liquid carrying vessel.

The word thick is used in the broad sense of the word. The actual thickness of the mat 12 would be determined by the size and water displacement of the tanker or vessel to be fitted wit the containment system.

The cushioning mats 12 used to protect against side collisions by other vessels need not be as thick as the bottom mats 12 used to protect against grounding. This is because they do not have to bear the weight of the ship and cargo in the event of hull failure, but should be thick enough to protect the compartment liner from damage. The side cushioning mats 12 would be installed parallel with the walls of the oil compartment in the same fashion as the bottom mats 12.

The shock provides a firm protective foundation for the liner 40 while maintaining elasticity and flexibility to lift and protect the cargo contained within the compartment liner 40. The coil springs 31 resist the upward movement of the rigid steel hull of the vessel as it begins to buckle from the external pressure exerted by submerged rocks or other objects.

The butt of the coil spring is a solid steel plate welded to the bottom end of the coil spring.

The butt plate has an access hole 17 in the center of it that is threaded to allow the threaded ends of the cable to be screwed into the coil spring.

The steel cables 21 that run through the interlocking mat sections and connect to the coil springs has threaded ends 18 that screw into the coil spring butt plate 42 allowing the tension on the mat sections 12 to be adjustable.

The coil spring is composed of a certain number of coils that terminate at the opposite end of the butt plate.

The coil spring section opposite the butt plate has an extended arm 16 at the center line of the spring, this arm is threaded to receive a lock nut and washer 10 once the arm is inserted through the access hole in the anchor beam 15.

Much of the energy from the external pressure created by the grounding is transferred to the side anchor beam 15. This is done through heavy steel cables 21 screwed into the butt plate 42 of the coil springs 31 that are screwed into the anchor beam 15 located at the sides of the compartment by means of access holes in the anchor beams 15.

The connecting end of the coil springs 31 are fashioned like a threaded bolt 16 which is inserted through the access holes in the anchor beams 15 and secured to the beam 15 by washer and nut assembly 10.

The butt plate 42 of the coil springs 31 is welded to the flat bottom end of the coil springs 31.

The butt plate 42 consists of a solid steel plate 42 that covers the end of the cool springs 31. There is a threaded access hole 17 located int he center of the butt plate 42 to allow the threaded ends of the heavy steel cables 21 to be screwed into the coil springs 31.

The steel cables 21 (called connecting rods) are inserted through access holes in the interlocking mat sections 12. The cables 21 afford greater flexibility to the mat 12 than do solid steel rods.

The cables 21 connecting the interlocking mat sections 12 are screwed into the butt plate 42 of the coil springs 31 at certain intervals along the entire length of the cargo compartment.

The steel cables 21 that are inserted through the mat sections 12 are then screwed into the butt plate 42. The end of the coil spring 31 are spaced in such a way as to afford the stable protective foundation for the compartment liner 40 that rests on the shock absorbing cushioning mat 12.

The slide plate is composed of two interlocking sections of steel plating connected by a round steel pin inserted through the horizontal and vertical sections of the slide plate assembly where they join together in an interlocking hinged.

The vertical section of the slide plate is welded to the side of the vessel and is stationary, while the horizontal section is free to pivot up and down by means of the steel pin inserted through the two sections of steel plating that make up the slide plate assembly.

The pivotal slide plate 81 is composed of sheet steel of a predetermined thickness to support the compartment liner 40 above the area of the coil springs 31 and anchor beams 15 along the sides of the oil or liquid cargo compartment. The horizontal section of the pivotal slide plate 81 extends from the vertical walls of the oil compartment to a distance over the edges of the shock absorbing cushioning mat 12 along the length of the oil compartment.

The vertical section of the pivotal slide plate 82 is welded to the vertical walls of the cargo compartment.

The horizontal plates 81 and vertical plate 82 of the pivotal slide plate are secured together by means of a steel pin 19 inserted through a hinge connection to allow the plates to pivot up and down, in order to accommodate the motion of a vessel traveling across a body of water.

The pivotal slide plates 81 and 82 also eliminate a great deal of stress on the compartment liner fasteners at the top of the cargo compartment.

The downward pressure of the cargo is directed towards the center of the vessel which is absorbed by the coil springs 31 and loaded cushioning mat 12.

This invention addresses the problems experienced in the prior art concerning the use of flexible diaphragms as disclosed in the U.S. Coast Guard report, evaluation of membrane oil pollution prevention, system research CG-d-175-75.

By addressing the problems of liner fasteners and the likelihood of liners being torn or ruptured by steel being forced inward by external pressure, the present invention would improve the safety of transporting oil or other potential pollutants across open seas in bulk liquid carrying vessels.

The pivotal slide plate 81 also provides protection for the compartment liner 40 should the coil spring 31 snap under severe stress of a grounding or collision.

The pivotal slide plate 81 and 82 are considered an important feature of the containment system of the present invention because, they support the cargo along the vertical walls of the compartment thereby eliminating stress on the fasteners, while allowing the liner 40 to make a smooth transition from the vertical walls of the oil compartment to the horizontal surface of the shock absorbing cushioning mat 12.

The pivotal slide plates 81 and 82 also help to maintain stability and floatability of the vessel once the hull has been ruptured. This is because the weight of the liquid cargo contained within the liner pressing down against the slide plate 81 and the shock absorbing cushioning mat 12 creates a limited seal against sea water entering through the ruptured hull of the bulk liquid carrying sea going vessel.

The invention can be modified to incorporate an inflatable mat 13 whereby the liner 40 rests on a cushion of air as opposed to the solid rubber mat 12.

The air mat 13 is connected to the coil springs 31 by hooks 25 that are inserted through the flange 26 that borders the inflatable version of the mat 13.

The oil or liquid cargo is protected at the three points with the inflatable mat 13. First, at the lower surface of the mat 13; second, the top or upper surface of the mat 13; and finally, the compartment liner 40 itself.

The spring 31 connection to the inflatable mat 13 has been modified with hooks 25 in the place of the screw-in butt plate 42 of the cable 21 connected solid rubber cushioning mat 12 containment system.

The air supply tanks 23 are fed by on-board compressors to inflate the modified mat 13. These tanks 23 keep the mat 13 inflated to the required pressure needed to support the weight of the oil filled compartment liner 40.

The on-deck compressed air tanks 23 have air supply lines 22 that extend to the modified inflatable mat 13. The air lines 22 would feed air to the modified version of the mat 13 from the bottom when the slide plates 81 has to rest on the modified version of the cushioning mat 13.

The modified inflatable mat 13 could be used as a safety device in sport and pleasure boats against being swamped in heavy seas or hull failure due to striking submerged or floating objects.

Without further elaboration, the foregoing will so fully illustrate our invention that others may, by applying current or future knowledge, adopt the same for use under various conditions of service.

SUMMARY OF THE INVENTION

The inventor is aware of the prior art made of record, that discloses the ejector piping system of McLaughlin, U.S. Pat. No. 3,844,239, and the releasable fixed lining of the oil compartment.

The present invention primarily addresses the protection of the liner from puncture or tearing by steel being forced inward by external forces.

The present invention is specifically designed to provide a shock absorbing counterfource to external pressure to protect the liner.

The external force of grounding collision would be absorbed by the superstructure of the bulk liquid carrying vessel by the spring loaded mat and cable assembly of the present invention. The liquid containment systems of the prior art as expressed by the Warner and Frederick patents do not address the problems of liner failure due to rupture or tearing by steel being forced inward. The shock absorbing cushioning mat is installed at a predetermined height form the bottom of the cargo compartment to allow the vessel's superstructure to support the cargo, minimizing stress on the fasteners and the vessel's steel plating. The tension of the coil springs are predetermined to allow for the greatest stability of the mat sections.

In the containment systems of the prior art, the liner and buffer compartments are in direct contact with the outer skin of the vessel's hull. Therefore, the liner and/or buffer compartment would have to absorb the full effects of the collision or grounding.

Without the benefits of the shock absorbing cushioning effects of the present invention, spillage of the pollutant cargo of the bulk liquid carrying vessel's cargo would be likely.

The buffer zone system is still vulnerable to spills as the water filled buffer zone liner is unprotected from steel being forced inward from external pressure. Once the liner is ruptured the water within would offer little or no resistance to the external force.

In the prior art of compartments liners the problem of fastening the liner to the walls of the compartment still exists.

The present invention addresses this problem by providing a flexible foundation for the liner thereby minimizing stress on the fasteners under various sea conditions.

The present invention would greatly improve the safety of both the compartment liner and buffer zone systems of the prior art.

What is claimed as the invention is:

1. An oil containment system for use in the hull of an oil carrying tanker, wherein the oil is held by an impervious liner supported by at least one pivotal slide plate, said liner being spaced at least in part from said hull to define a space, a flexible mat comprised of sections and positioned generally horizontally in said space, strengthening cables passing through said flexible mat sections, said cables having portions attached to said hull through spring means whereby in the event of a collision involving said hull, said mat will be urged toward said liner, but said mat spring means will set up liner protective counterforces in opposition to the source of said collision as well as preventing leakage of said liner and cushioning the destructive effect of sharp objects such as the sharp edges of hull beams.

2. The system of claim 1 wherein said liner is of heavy gauge vinyl, and said liner rests on said mat.

3. The system of claim 1 wherein said mat comprises interlocking sections superimposed one on the other.

4. The system of claim 3 wherein said cables pass through said mat interlocking sections.

5. The system of claim 1 wherein said cables have threaded ends that are attached to said spring means.

6. The system of claim 5 wherein said spring means are coil springs having a butt plate.

7. The system of claim 6 wherein said spring means act as shock absorbers in the event of a collision to absorb downward weight of the tanker, thereby causing the spring means to expand and transfer energy through said cables from the bottom of the hull to the hull beams of the tanker.

8. The system of claim 1 wherein said cable end and coil spring butt plate have complementary threads.

9. The system of claim 1 wherein said cables have ends and said coil springs have a butt plate with complimentary threads.

10. The system of claim 9 wherein said slide plate is comprised of pivotable generally horizontal and vertical sections, said horizontal section lending support to said liner.

11. The system of claim 10 wherein said slide plate also includes a slide plate hinge, said slide plate enabling the liner to make a smooth transition from the vertical walls of the oil compartment to the horizontal surface of said mat, and said mat protects the liner from damage as the coil springs expand and the mat sections move toward the center of the tanker in the event of a collision.

12. The system of claim 10 wherein the vertical arm of said slide plate is secured to the hull, and the slide plate hinge allows vertical movement of the liner.

13. An oil containment system for use in the hull of an oil carrying tanker, said oil being held by an impervious liner supported by at least one pivotal slide plate, said liner being spaced at least in part from a hull of said vessel to define a space, and air mat bladder means positioned in said space and connected to coil springs attached to the sides of beams of said vessel, air access means in said bladder, air supply means operatively connected to said air access means, and hook means securing said bladder to said coil springs.

* * * * *